United States Patent [19]

Masquelier

[11] 4,197,036

[45] Apr. 8, 1980

[54] APPARATUS FOR FORMING NARROW DRAINAGE TRENCHES

[76] Inventor: Henry Masquelier, Hameau du Mesnil, Sailly-lez-Lannoy, Lys -lez-Lannoy, (Nord), France

[21] Appl. No.: 895,439

[22] Filed: Apr. 11, 1978

[51] Int. Cl.[2] ..... E02F 5/08; E02F 5/12

[52] U.S. Cl. ..... 405/303; 405/50; 37/95; 37/142.5

[58] Field of Search ..... 37/94, 95, 96, 142.5; 405/50, 303

[56] References Cited

U.S. PATENT DOCUMENTS

| | | | |
|---|---|---|---|
| 275,372 | 4/1883 | Fagan | 37/94 |
| 2,798,314 | 7/1957 | Brite | 37/94 |
| 3,067,533 | 12/1962 | Howard | 37/94 |
| 3,203,188 | 8/1965 | Evans | 37/142.5 UX |
| 3,611,730 | 10/1971 | Brettrager | 37/94 X |

FOREIGN PATENT DOCUMENTS

| | | | |
|---|---|---|---|
| 2164116 | 7/1973 | Fed. Rep. of Germany | 37/94 |
| 2355956 | 1/1978 | France | 37/96 |
| 1361611 | 7/1974 | United Kingdom | 37/142.5 |
| 1380398 | 1/1975 | United Kingdom | 37/95 |
| 388107 | 10/1973 | U.S.S.R. | 37/94 |
| 541944 | 3/1977 | U.S.S.R. | 37/142.5 |

*Primary Examiner*—Clifford D. Crowder

*Attorney, Agent, or Firm*—Robert E. Burns; Emmanuel J. Lobato; Bruce L. Adams

[57] ABSTRACT

An excavator comprising an excavating wheel mounted on a chassis, means supporting the chassis on the ground such that a portion of the wheel projects below ground level, and drive means for rotating the wheel about its axis, the wheel being adapted to cut a longitudinal trench having a predetermined transverse profile when it is rotated about its axis and the chassis is advanced over the ground in a given direction.

6 Claims, 5 Drawing Figures

APPARATUS FOR FORMING NARROW DRAINAGE TRENCHES

BACKGROUND OF THE INVENTION

The present invention relates to an excavator for excavating a longitudinal trench having a predetermined transverse profile.

Such an excavator may be used, for example, to form irrigation or drainage trenches which are much deeper than they are wide and which are intended, in the case of drainage, to direct the flow of surface water to an underground drainage system.

A requirement of such trenches is that their sides should have a precise orientation as well as good cohesion.

With the object of obtaining such regular and stable sides, machines are used at present which comprise two parallel discs cutting two parallel fissures in the ground, and a ploughshare placed behind the two discs to form the bottom of the trench and remove the strip of earth between the two fissures.

Such a machine makes it possible to obtain trenches having the required characteristics, but has the disadvantage of operating very slowly, in practice at less than two kilometers per hour, because of the considerable force required to cut and raise the earth.

SUMMARY OF THE INVENTION

In accordance with the present invention there is provided an excavator comprising an excavating wheel mounted on a chassis, means supporting the chassis on the ground such that a portion of the wheel projects below ground level, and drive means for rotating the wheel about its axis, the wheel being adapted to cut a longitudinal trench having a predetermined transverse profile when it is rotated about its axis and the chassis is advanced over the ground in a given direction.

Thus the dividing into sections and removal of earth is carried out without any noticeable effect on traction.

The excavating wheel preferably comprises a disc provided with teeth located alternately on both sides of it in such a way that the earth is attacked alternately from one side and then the other. The earth thus crumbles in the intermediate area between adjacent teeth, and is then picked up and removed by the succeeding teeth. This removal of the earth is preferably made easier by providing a ramp which follows the external periphery of the wheel so that the earth is carried up by the ramp by the teeth.

Tests have shown that such an excavator can operate at a speed of more than double the speed of operation of present trench-digging machines, the forces developed for digging the earth no longer opposing the tractive force applied to the machine.

In a preferred embodiment of the invention, the digging of the trench by the excavating wheel is accompanied by a compacting of the earth on both sides of the trench, the excavator resting on a pair of skids straddling the trench. This increases the stability of the sides of the trench.

DESCRIPTION OF A PREFERRED EMBODIMENT

The illustrated excavator is connected to an agricultural tractor by a conventional three-point draw bar 1, but self-propelled excavators could also be provided according to the invention.

Figure 1:
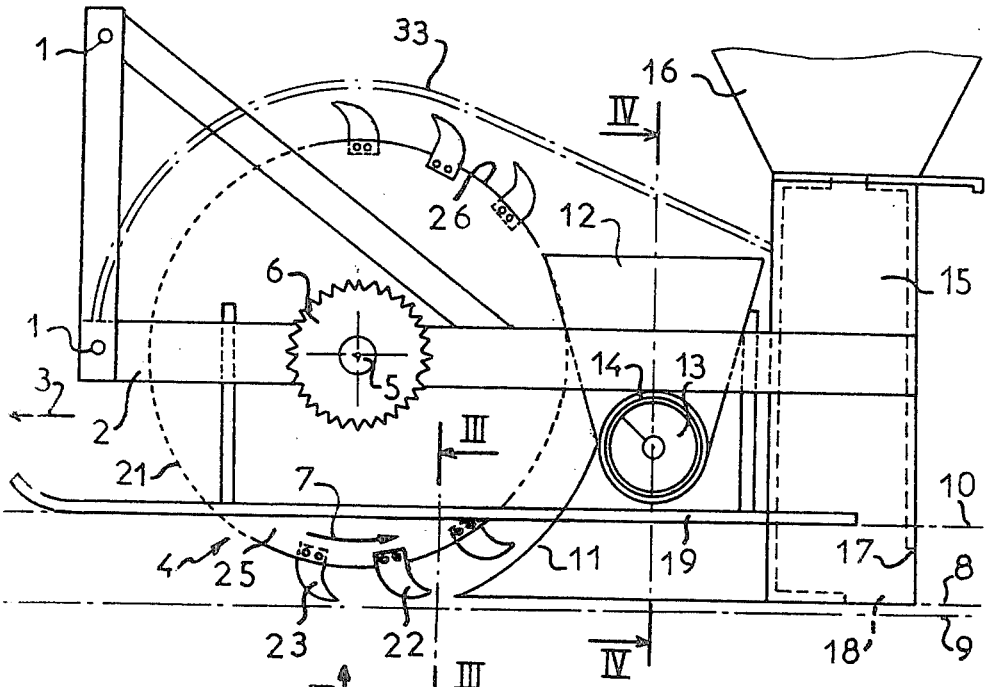
FIG. 1 shows a lateral view of the excavator.
Figure 2:
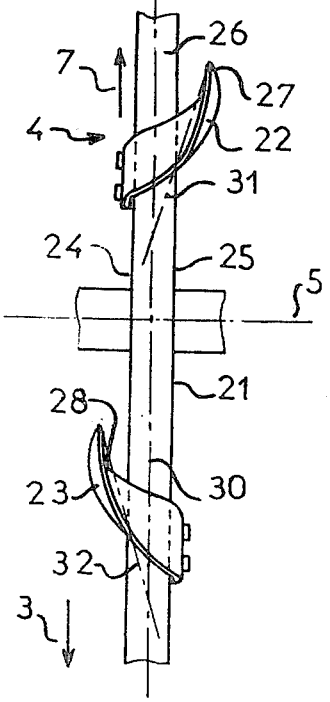
FIG. 2 shows a view from below in the direction of the vertical arrow II of one part of the toothed disc defining the excavating wheel.
Figure 3:
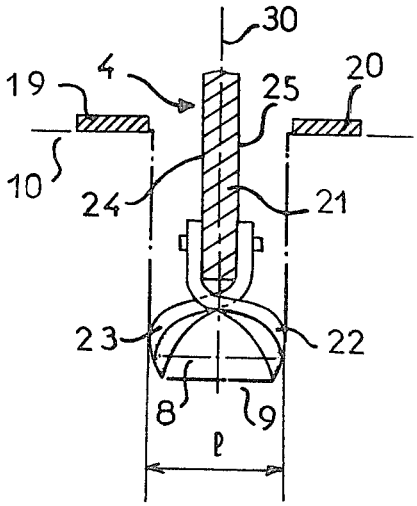
FIG. 3 shows a view of the lower part of the excavating wheel in section along the plane III—III of FIG. 1.

In FIGS. 1 to 3 the excavator includes a longitudinal chassis 2 which is pulled by a tractor in the direction of the trench which is to be dug and in the direction of the arrow 3, the draw bar 1 being located at the front end of the machine, taking this direction of movement into account.

The chassis 2 carries at least one excavating wheel 4 mounted for rotation about its axis 5 which lies transverse to the direction 3.

As shown, the axis 5 of the wheel is generally horizontal and the wheel vertical, but other slanting orientations could be used if the shape of the trench to be dug required it.

The wheel 4 is driven by means of a toothed pinion 6 which, in use, is connected to a power drive from the tractor.

Rotation can take place in one direction or the other, but it preferably takes place in such a direction that the bottom part of the wheel 4 attacks the ground downwards and moves rearwards as indicated by the arrow 7.

In order to assist in the removal of earth cut by the wheel 4, there is provided an ascending ramp 11 which follows externally the periphery of the wheel. The bottom edge of the ramp lies at a level 8 intermediate the bottom of the trench 9 and ground level 10, behind the wheel 4.

Above ground level, the ramp 11 opens into a transverse hopper 12 behind the wheel 4.

In FIG. 1, the bottom of this transverse hopper 12 is provided with an Archimedean screw 13 which extends into a transverse cylindrical tube 14; this screw removes the collected earth and is rotated, for example, by a power output connection of the tractor. It opens into storage buckets or transporting means of any known type.

Behind the ramp 11 and behind the chassis 2, the excavator includes a vertical tipping chute 15 for tipping material into the trench which has been excavated. The bottom of chute 15 lies at the level 8 coinciding with the bottom edge of the ramp 11. A hopper 16 (shown partly in section in FIG. 1) surmounts this chute 15 and supplies it with the desired material. This material may consist, for example, in the case of a drainage trench, of broken stones or a granulated material.

The upper level of any such tipping material in the trench dug by the machine is defined by the upper edge 17 of an aperture 18 of the chute, the aperture being formed in the bottom and the rear walls of the chute, below the level 10 of the ground.

The transverse dimensions of the ramp 11 and the chute 15 in relation to the direction 3 are preferably substantially equal to the transverse dimension of the excavating wheel 4, that is to say, to the width "l" of the trench which has been dug. This prevents the walls of the trench caving in before tipping of the desired material into the trench.

In order to limit the sinking of the wheel 4 into the ground and to define the level 9 of the bottom of the trench, which coincides with the bottom edge of the lowermost tooth of the wheel 4, the excavator includes two horizontal skids 19 and 20 straddling the dug trench; these skids 19 and 20 thus not only control the level of the machine but also compact the edges of the trench. This improves the cohesion of the sides of the trench. The skids 19 and 20 are preferably extended rearwards in relation to the wheel 4, to cooperate with the edges of the ramp 11 and of the tipping hopper 15, with this same object of compacting the sides of the trench.

Naturally, the excavating wheel 4 may have various shapes, but one preferred shape has been represented, according to which it is defined by a flat disc 21 revolving about the axis of rotation 5, the disc being provided around its circumference with a plurality of teeth projecting both in relation to this circumference and laterally, alternately on both sides of the disc; each of these teeth has a forward cutting edge in relation to the direction of rotation 7 (that is to say rearwards in relation to the direction of the arrow 3) in the wheel part 4 which penetrates the ground.

In FIGS. 2 and 3 two successive teeth 22 and 23 are shown, each of which is fixed to a respective one of the opposing faces 24 and 25 of the disc 21 to project in relation to the other face after having straddled the circumference of the disc. The front cutting edge of these teeth 22 and 23 has been represented by 27 and 28 respectively.

The teeth are preferably detachable from the disc and can be fixed to either face. In this way the width of the trenches can be varied. Control of the depth of the trench is obtained by adjusting the level of the skids 19 and 20 in relation to the chassis 2, for example, by means of screw jacks (not shown) connecting these elements.

It can be seen, particularly in FIG. 2, that the teeth such as 22 and 23 are slanted in relation to the general plane 30 of the disc 21: the inclination of each tooth is shown by lines 31 and 32 respectively, which intersect the plane 30 of the disc rearwards in relation to the direction of rotation 7. Such a shape tends to create a dredger effect to facilitate the removal of earth by the excavating wheel and the piling up of it along the ramp 11 towards the rear of the trench.

The location of the teeth in alternate rows avoids the need for tamping of the excavating wheel, provided that a minimum spacing between two successive teeth is observed. However, two successive teeth must not be too far apart, as excessive spacing produces uneven cutting of the bottom of the trench.

Depending upon the ground being excavated, the cutting speed of the machine can be varied either by controlling the speed of translation of the machine in the direction of the arrow 3 or the speed of rotation of the wheel in the direction of the arrow 7.

Particularly when it is intended to resolve in heavy ground, it will be preferable to replace the Archimedian screw 13 for lateral removal of earth in the upper part of the ramp 11 by a turbine consisting of a wheel with blades which rotates inside a housing at a speed which guarantees a discharge which is much greater than that of the excavating wheel, in order to break up any clods and eject the earth in a broken up condition sideways without risk of jamming.

This turbine can be driven advantageously by a hydraulic motor, which has the double advantage of guaranteeing its high speed of rotation and of being more simple and more robust than a driver of mechanical type.

Figure 5:
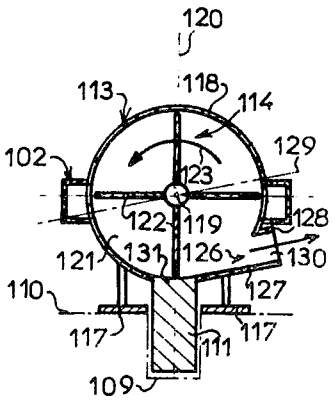
FIG. 5 shows a view of this excavator in section along the plane V—V of FIG. 4.
Figure 4:
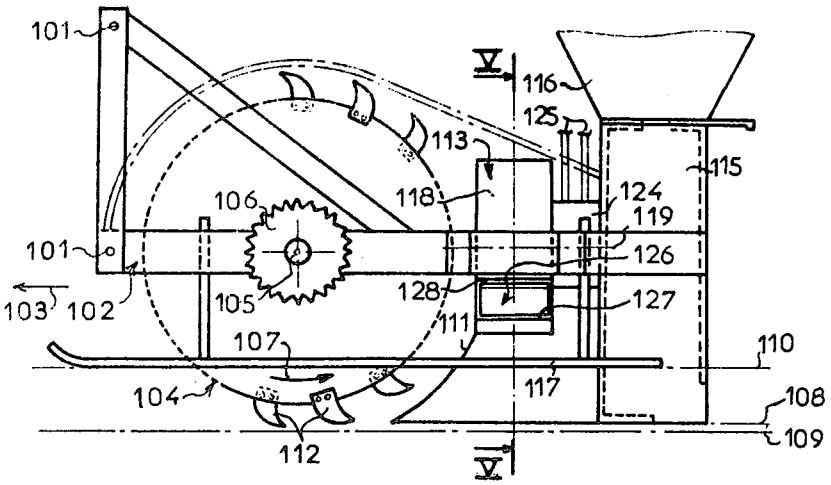
FIG. 4 shows a lateral view of one variation of the excavator.

Such an embodiment, which is unchanged in other respects, is illustrates in FIGS. 4 and 5.

In FIG. 4 is found the longitudinal chassis 102 of the machine, which is designed, for example, for attachment to a tractor by means of a conventional three point draw bar 101 which moves this chassis longitudinally, according to the direction of the trench to be dug, in the direction indicated by the arrow 103; the chassis 102 has at least one excavating wheel 104 rotated around its axis 105 at right angles in relation to the direction 103, for example by a toothed wheel 106 connected to the power source of the tractor. During this rotation, the lower part of the wheel, which penetrates into the ground in order to dig the trench there, rotates backwards as shown diagrammatically by the arrow 107; during this rotation, the peripheral teeth 112 of the wheel push the removed earth backwards, and this earth is guided, from an intermediate level 108 between the level 109 of the lower part of the wheel and the level 110 of the ground, by an ascending ramp 111 having a contour which corresponds to the shape of the periphery of the wheel on the outside at the rear of the latter.

In its upper end which is always situated above the level 110 of the ground, that is, above the longitudinal skids such as 117 which guarantee the support of the machine on the ground either side of the excavating wheel 104, the ascending ramp 111 emerges inside a housing 113, which corresponds to the shape of a bladed wheel 114, which is situated between the excavating wheel 104 and chute 115 which latter is situated at the extreme rear of the machine for pouring into the dug out trench a granular material stored in a hopper 116.

If one refers more especially to FIG. 5, it is seen that the housing 113 has a wall 118 which is approximately cylindrical for revolution about an axis 119 which is arranged here horizontally according to the vertical longitudinal median plane 120 of the whole machine, and especially of the ramp 111; it is, however, to be noted that the orientation of this axis 119 could be different, that is, oblique in relation to the horizontal and/or in relation to the plane 120, or again parallel to this plane 120 according to any direction in relation to the horizontal; the housing 113 is moreover circumscribed by two end walls in the form of a disc at right angles in relation to the axis 119, such as 121.

The upper part of the ramp 111 emerges on the inside of the housing 113 in the immediate proximity of the lower generatrix of the cylindrical wall 18 of the housing, via an aperture 131 of the housing 113.

When it arrives inside the housing 113, the earth rising upwards along the ramp 111 is situated on the obligatory path through the blades 22 of the wheel 114 on rotation of the latter about the axis 119 in the direction of the arrow 123, preferably under the influence of a hydraulic motor 124 supplied via pipes 125 by a source of liquid under pressure which is not shown, which, for example, can be the hydraulic central power plant of the tractor which manoeuvers the machine or by a hydraulic pump activated by the power plant of the tractor.

The blades 122 are, for example, orientated radially in relation to the axis 119 and their periphery is situated in the immediate proximity of the internal face of the cylindrical wall 118 and the internal face of the end walls such as 121 in such a manner that the earth entering the housing 113 in the upper part of the ramp 111 is immediately pushed laterally by the blades 122 which are successively presented perpendicularly to this ramp 111.

The rate of rotation of the bladed wheel 114 in the direction of the arrow 123 is high and in practice much higher than that of the excavating wheel 104, in such a manner that the blades 122 can laterally push the earth following a discharge which is much greater than that at which the excavating wheel brings the earth inside the housing 113; hence, the bladed wheel 114 divides this earth even if it is very wet and ejects it laterally at high speed through an opening 126 of the cylindrical wall 118 of the housing 113, arranged preferably in the immediate proximity of the zone in which the upper part of the ramp 111 emerges inside the housing 113 to preserve this effect of violent ejection of the earth by the blades 112 on its arrival inside the housing 113.

The opening 126 is designed here in such a manner as to play the part of a deflector guiding the earth ejected in order to impart to the ejected earth movement, which is directed laterally in relation to the direction of movement of the machine, an ascending slope in the direction of a movement away in relation to this machine.

In practice, the opening 126 is demarcated here, outside the housing 113, by a deflecting wall 127 directed tangentially in relation to the wall 118 along a generatrix of this wall situated at a level slightly higher than that of its lower generatrix in such a manner that this wall 127 has an oblique direction in relation to the plane 120 and it ascends in the direction away from this plane; it is also demarcated by a wall 128, which is parallel to the wall 127, in the upper part of the opening 126, above the wall 127 but preferably below a plane 129 which is parallel to the wall 127 and passes through the axis 119 of the wall 118, and by two walls such as 130 which prolong the lateral walls such as 121 between the two walls 127 and 128.

As it emerges from the housong 113 by means of the opening 126, the ejected earth can be gathered up by any means, possibly by means of a transporting device of known type whose feed zone is conveniently arranged in relation to the opening 126.

Naturally the invention lends itself to numerous variants in relation to the implementation described and represented, as to the methods of implementation of the turbine 113–114–124 for lateral evacuation of earth and regarding the method of implementation of the other elements of the machine.

The machine can have certain accessory arrangements whose object is to improve its convenience or its safety in use. For example, in FIG. 1 there has been indicated the profile of a gear case 33 covering the part of the wheel 4 which is situated above the chassis 2 and the hopper 12. This case prevents excavated earth being thrown upwards.

What we claim is:

1. An excavator for digging a trench having greater depth than width and having smooth firm walls, which comprises:

a chassis, means supporting said chassis on the ground, said supporting means comprising two skids engaging the ground on opposite sides of a trench being dug and close to said trench to support and compact the earth on opposite sides of the trench, and means for moving said chassis, an excavating wheel mounted on said chassis for rotation about a transverse axis above ground level, said wheel extending down between said skids to the depth of the trench to be dug and comprising a flat disc and a plurality of teeth spaced around the circumference of said disc and projecting laterally alternatively on opposite sides of said disc, each of said teeth having a front cutting edge in relation to the direction of rotation of said wheel, drive means for rotating said wheel in the direction that the lower portion of said wheel moves rearwardly with respect to the direction of movement of said chassis, a ramp arranged to receive earth excavated by said wheel, said ramp having a bottom edge located rearwardly of the lower portion of said wheel and near the bottom of the trench being dug, a contour which follows the external periphery of said wheel behind the wheel in relation to the direction of movement of said chassis, and an upper end above ground level, said ramp having a transverse dimension which is essentially equal to the transverse dimension of said wheel and thereby controlling and maintaining the transverse profile of the trench, and means at the upper end of said ramp for removing earth laterally from said ramp, said removing means comprising a generally circular housing with a discharge opening directed tangentially of said housing and laterally of said chassis and an inlet opening receiving excavated earth from the upper end of said ramp, a bladed wheel rotatable in said housing in a direction to receive excavated earth from said ramp and project it out through said discharge opening, and means for driving said bladed wheel at a speed of rotation much greater than the speed of rotation of said excavating wheel.

2. An excavator according to claim 1, in which said removing means further comprises a deflector extending from a lower side of the discharge opening of said housing in a direction which is tangential to said housing and inclined upwardly.

3. An excavator according to claim 1, in which each of said teeth of the excavating wheel is generally inclined along a line which intersects the plane of said disc behind said tooth in relation to the direction of rotation of said excavating wheel.

4. An excavator according to claim 3, in which each of said teeth of said excavating wheel is cupped with a convex surface engaging the side of the trench rearwardly of said cutting edge to smooth and compact the sides of the trench.

5. An excavator according to claim 1, in which said skids extend rearwardly of said excavating wheel in relation to the direction of movement of the chassis.

6. An excavator according to claim 1, further comprising means for introducing gravel or like filling material into said trench behind said excavating wheel, said introducing means comprising a hopper for said material, and a chute extending down from said hopper into the trench behind said excavating wheel and ramp, said chute having a forward bottom edge at approximately the level of the bottom edge of said ramp and a rear bottom edge at the level to which said material is to be filled in said trench, said ramp having side walls extending rearwardly substantially to said chute to maintain the sides of said trench until said material is introduced therein.

* * * * *